US010306935B2

(12) United States Patent
Knipp et al.

(10) Patent No.: US 10,306,935 B2
(45) Date of Patent: Jun. 4, 2019

(54) ADJUSTABLE CLOTHING FOR PHYSICALLY IMPAIRED USERS

(71) Applicants: Lawrence J. Knipp, Austin, TX (US); Wanda V. Molinary, Austin, TX (US); Veronica N. Knipp, Austin, TX (US); Gregory A. Knipp, Austin, TX (US); Mitchell L. Knipp, Austin, TX (US)

(72) Inventors: Lawrence J. Knipp, Austin, TX (US); Wanda V. Molinary, Austin, TX (US); Veronica N. Knipp, Austin, TX (US); Gregory A. Knipp, Austin, TX (US); Mitchell L. Knipp, Austin, TX (US)

( * ) Notice: Subject to any disclaimer, the term of this patent is extended or adjusted under 35 U.S.C. 154(b) by 158 days.

(21) Appl. No.: 15/070,609

(22) Filed: Mar. 15, 2016

(65) Prior Publication Data

US 2016/0286873 A1 Oct. 6, 2016

Related U.S. Application Data

(60) Provisional application No. 62/139,793, filed on Mar. 30, 2015.

(51) Int. Cl.

| | |
|---|---|
| ***A41D 13/12*** | (2006.01) |
| ***A41D 27/10*** | (2006.01) |
| ***A41D 31/00*** | (2019.01) |

(52) U.S. Cl.

CPC ..... *A41D 13/1245* (2013.01); *A41D 13/129* (2013.01); *A41D 13/1281* (2013.01); *A41D 27/10* (2013.01); *A41D 31/00* (2013.01)

(58) Field of Classification Search

CPC ..... A41D 13/1245; A41D 13/1281; A41D 13/129; A41D 27/10; A41D 31/00

See application file for complete search history.

(56) References Cited

U.S. PATENT DOCUMENTS 5,392,466 A 2/1995 Chou et al.
5,553,323 A 9/1996 Chou et al.
(Continued)

OTHER PUBLICATIONS

Tally, website: http://tallystreasury.com/2011/03/zippered-t-shirt-sleeves-and-front/, Mar. 12, 2011, 22 pages.
(Continued)

*Primary Examiner* — Clinton T Ostrup
*Assistant Examiner* — Andrew W Sutton
(74) *Attorney, Agent, or Firm* — Meyertons, Hood, Kivlin, Kowert & Goetzel, P.C.

(57) ABSTRACT

A system and/or method a may include adjusting an opening in a garment. The method may include disconnecting at least one fastener attaching a first portion of material to a second portion of the material forming an opening in a garment with a first diameter. The method may include expanding the first opening from the first diameter to a second larger diameter using a third portion of material attaching the first portion to the second portion of material. The method may include inserting an appendage of a user through the expanded opening. At least a portion of the appendage may include a medical device. The medical device may be inhibited from conveying through the opening with the first diameter. The method may include folding the third portion of material within the first diameter of the opening when the at least one fastener is activated.

15 Claims, 8 Drawing Sheets

(56) References Cited

U.S. PATENT DOCUMENTS

| | | | | |
|---|---|---|---|---|
| 5,564,126 | A | 10/1996 | Chou | |
| 6,595,936 | B1 * | 7/2003 | Oladipo | A61F 5/3746 602/20 |
| 8,161,573 | B1 | 4/2012 | Burns-Cox | |
| 2010/0299804 | A1 | 12/2010 | Huang | |
| 2010/0306901 | A1 | 12/2010 | Erickson | |

OTHER PUBLICATIONS

Marcel, Jessica, website: http://www.trendhunter.com/trends/adjustable-t-shirts, Sep. 13, 2009, 2 pages.

* cited by examiner

ADJUSTABLE CLOTHING FOR PHYSICALLY IMPAIRED USERS

PRIORITY CLAIM

This application is a claims priority to U.S. Provisional Patent Application No. 62/139,793 entitled "CONVERTIBLE WEARABLE TECHNOLOGY WHICH ALLOWS FOR ACCOMMODATION AND PROTECTION OF CASTS, BANDAGES, BRACES, PROSTHETICS AND OTHER OVERSIZED DEVICES" filed on Mar. 30, 2015, all of which is incorporated by reference herein.

BACKGROUND

Technical Field

Embodiments described herein relate to specialized clothing and garments. More particularly, some embodiments disclosed herein relate to clothing which is adjustable to allow for accommodation of medical devices worn by patients.

Description of the Related Art

The present disclosure relates to adjustable clothing for physically impaired users. Broken bones, especially broken arms and legs, are fairly common injuries. These types of injuries seem to be especially prevalent among children. Casts and/or other braces used to stabilize broken appendages make it difficult to put on and wear traditional clothing. Clothing which will fit appropriately over the resultant bandage and cast is very hard to find, as the bandage and cast is usually quite a bit larger in diameter than the arm hole in a shirt, or the leg in a pant leg.

Typically clothing already owned by a patient is taken and adapted as best as possible, usually cutting off shirt sleeves and/or pants legs. The resultant shirt, pant, or jacket remnant can be unsightly and only partially functional. The clothing is useful for the relatively short healing period (e.g., three to twelve weeks that a cast might be in place) and then discarded after that time period. The adapted clothing may still not fit properly and then after the broken bone heals the clothing is unusable.

Therefore a system and/or method which better allow an impaired individual with a cast on an arm or leg to put on and wear clothing would be beneficial

SUMMARY

In some embodiments, a system and/or method a may include adjusting an opening in a garment. The method may include disconnecting at least one fastener attaching a first portion of material to a second portion of the material forming an opening in a garment with a first diameter. The method may include expanding the first opening from the first diameter to a second larger diameter using a third portion of material attaching the first portion to the second portion of material. The method may include inserting an appendage of a user through the expanded opening. At least a portion of the appendage may include a medical device. The medical device may be inhibited from conveying through the opening with the first diameter. In some embodiments, the method may include folding the third portion of material within the first diameter of the opening when the at least one fastener is activated.

In some embodiments, a method may include activating the at least one fastener to attach the first portion of material to the second portion of the material forming the opening. After the fastener is activated the opening may be now locked into the first diameter after the medical device of the appendage has passed through the opening.

In some embodiments, a method may include enlarging the opening by cutting the material forming the opening where the first portion and the second portion of material are attached. The method may include attaching the third portion of material to the first and the second portions of material.

BRIEF DESCRIPTION OF THE DRAWINGS

The following detailed description makes reference to the accompanying drawings, which are now briefly described.

Figure 1:
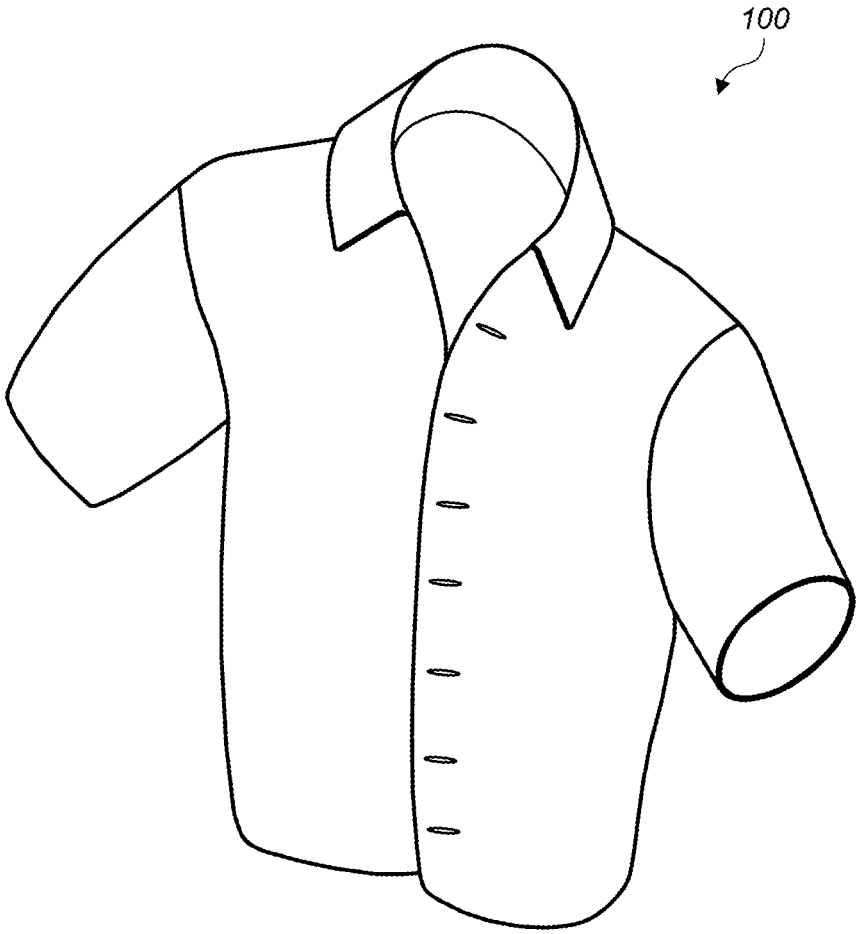
FIG. 1 depicts an embodiment of a current button down short sleeve shirt.

Specific embodiments are shown by way of example in the drawings and will be described herein in detail. It should be understood, however, that the drawings and detailed description are not intended to limit the claims to the particular embodiments disclosed, even where only a single embodiment is described with respect to a particular feature. On the contrary, the intention is to cover all modifications, equivalents and alternatives that would be apparent to a person skilled in the art having the benefit of this disclosure. Examples of features provided in the disclosure are intended to be illustrative rather than restrictive unless stated otherwise.

The headings used herein are for organizational purposes only and are not meant to be used to limit the scope of the description. As used throughout this application, the word "may" is used in a permissive sense (i.e., meaning having the potential to), rather than the mandatory sense (i.e., meaning must). The words "include," "including," and "includes" indicate open-ended relationships and therefore mean including, but not limited to. Similarly, the words "have," "having," and "has" also indicated open-ended relationships, and thus mean having, but not limited to. The terms "first," "second," "third," and so forth as used herein are used as labels for nouns that they precede, and do not imply any type of ordering (e.g., spatial, temporal, logical, etc.) unless such an ordering is otherwise explicitly indicated. For example, a "third fastener coupled to a garment" does not preclude scenarios in which a "fourth fastener coupled to the garment" is connected prior to the third fastener, unless otherwise specified. Similarly, a "second" feature does not require that a "first" feature be implemented prior to the "second" feature, unless otherwise specified.

Various components may be described as "configured to" perform a task or tasks. In such contexts, "configured to" is a broad recitation generally meaning "having structure that" performs the task or tasks during operation. As such, the component can be configured to perform the task even when the component is not currently performing that task. In some contexts, "configured to" may be a broad recitation of structure generally meaning performs the task or tasks during operation. As such, the component can be configured to perform the task even when the component is not currently on.

Various components may be described as performing a task or tasks, for convenience in the description. Such descriptions should be interpreted as including the phrase "configured to." Reciting a component that is configured to perform one or more tasks is expressly intended not to invoke 35 U.S.C. § 112 paragraph (f), interpretation for that component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

DETAILED DESCRIPTION OF EMBODIMENTS

Definitions

Unless defined otherwise, all technical and scientific terms used herein have the same meaning as commonly understood by one of ordinary skill in the art.

The term "connected" as used herein generally refers to pieces which may be joined or linked together.

The term "coupled" as used herein generally refers to pieces which may be used operatively with each other, or joined or linked together, with or without one or more intervening members.

The term "directly" as used herein generally refers to one structure in physical contact with another structure, or, when used in reference to a procedure, means that one process effects another process or structure without the involvement of an intermediate step or component.

This specification includes references to "one embodiment" or "an embodiment." The appearances of the phrases "in one embodiment" or "in an embodiment" do not necessarily refer to the same embodiment. Particular features, structures, or characteristics may be combined in any suitable manner consistent with this disclosure.

The embodiments described herein may be applied to all apparel including, but not limited to, short sleeve shirt, long sleeve shirt, jacket, pants, or uniforms (military and non-military). If used with a shirt, the type of shirt may include, but is not limited to, button down, collared, golf shirt, t-shirt, dry fit, zipper, etc. Herein the embodiments most described will be directed towards a short sleeved shirt and specifically the sleeve of the shirt. System described herein may be fitted to accommodate collars and neck pieces as well as any other garment opening. In some embodiments, the shirt comprises a normal shirt, extra 'flap' pieces, and some closure device(s).

FIG. 1 depicts an embodiment of a current button down short sleeve shirt 100. In some embodiments, a garment may include an adjustable garment system incorporated therein. The adjustable garment system may include a garment. Garments may include an article of clothing worn by a person. Specifically garments may include an article of clothing worn by a person including an opening in the garment meant for a portion (e.g., an appendage) of the person to be conveyed through.

Figure 2:
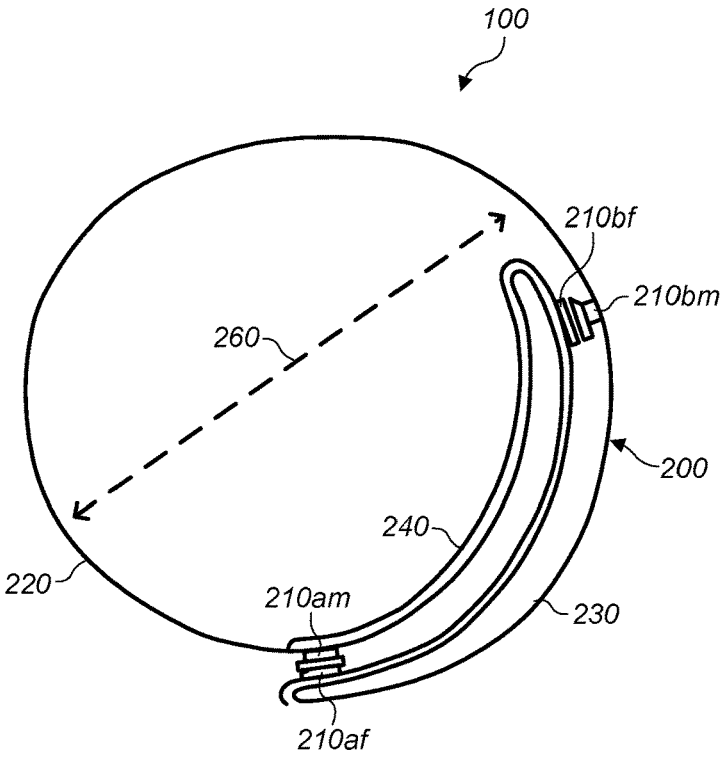
FIG. 2 depicts an embodiment of an adjustable garment system inserted into a short sleeve shirt, compressed and comprising a first diameter.

In some embodiments, a portion of the garment may be at least partially formed from a flexible material. The garment may include an opening through which an appendage of a user is positionable during use. The opening may include a first diameter. FIG. 2 depicts an embodiment of an adjustable garment system 200 inserted into a short sleeve shirt 100, compressed and comprising a first diameter 260.

Figure 3:
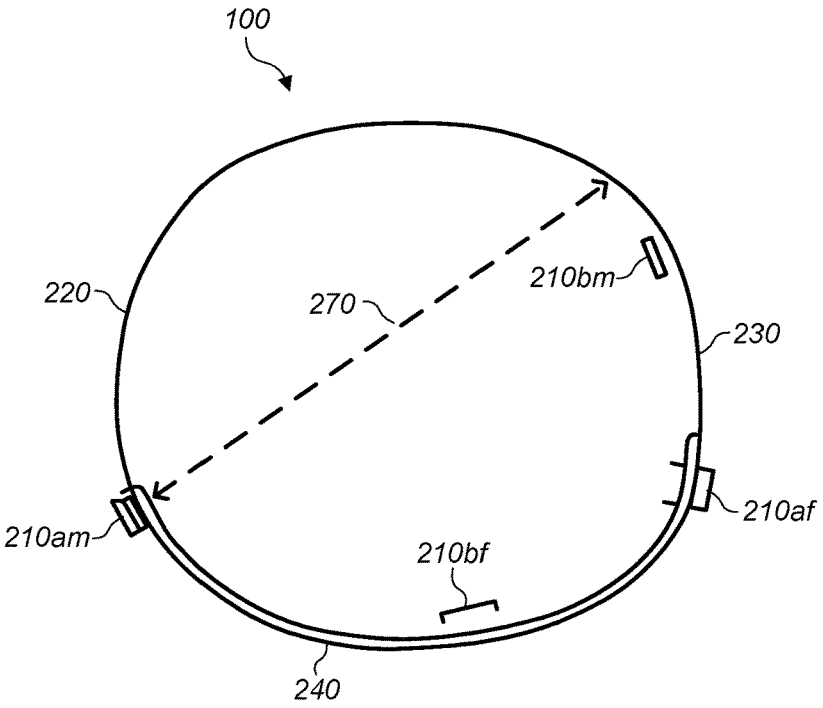
FIG. 3 depicts an embodiment of an adjustable garment system inserted into a short sleeve shirt, expanded and comprising a second diameter.

In some embodiments, an adjustable garment system 200 may include at least one fastener 210 (e.g., in FIGS. 2-3 two pairs of complementary fasteners are depicted: 210*am* (m=male) couples to 210*af* (f=female) and 210*bm* couples to 210*bf*). A fastener may, when activated during use, attach a first portion of material 220 forming the opening to a second portion 230 of the material forming the opening such that the opening comprises a first diameter. Typically the adjustable garment system may include a plurality of fasteners positioned along the first and the second portions of material which function to attach the first portion to the second portion.

In some embodiments, a fastener may include any device that mechanically joins or affixes two or more objects together. Fasteners may involve keeping together the sides of an opening of flexible material. In some embodiments, fasteners may include buckles, buttons, clasps, clamps, ties, clips, hook and loop, hook, hook-and-eye, latch, stitches, zipper, lacing, thread, filament, magnetic latches, electrical latches, drawstring, etc.

In some embodiments, when the at least one fastener 210 is unfastened the first portion 220 is detached from the second portion 230 of the material forming the opening such that the opening expands from the first diameter to a second diameter. The second diameter may be larger than the first diameter. FIG. 3 depicts an embodiment of an adjustable garment system 200 inserted into short sleeve shirt 100, expanded and comprising a second diameter 270. In some embodiments, the second diameter may include a variable diameter over a range with the minimum of the range having a larger diameter than the first diameter.

Figure 4:
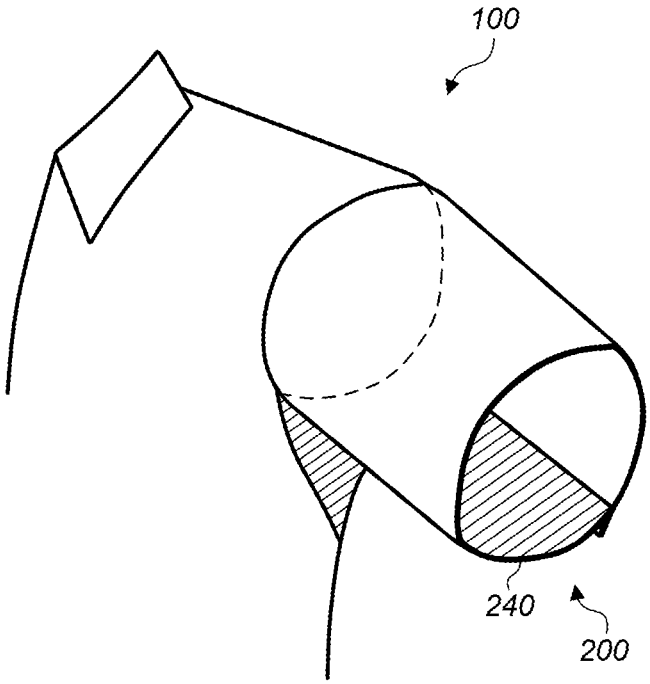
FIG. 4 depicts an embodiment of a third portion of material or flap inserted into a short sleeve shirt, wherein the flap is expanded to a second diameter.

In some embodiments, an adjustable garment system may include a third portion of material 240 (e.g., as depicted in FIG. 3). The third portion 240 of material may couple (e.g., directly attached) the first portion 220 of the material to the second portion 230 of material. The third portion of the material may allow the opening to enlarge when the fasteners are unfastened while still maintaining a continuous portion of material forming the opening of the garment. FIG. 4 depicts an embodiment of a third portion of material 240 or flap inserted into a short sleeve shirt 100, wherein the flap 240 is expanded to a second diameter.

In some embodiments, the third portion of material coupling the first portion to the second portion may fold within the first diameter of the opening when the at least one fastener is activated. The third portion of material may be precreased such that the portion folds substantially flat within the opening when the fasteners are activated and the opening includes the first diameter.

In some embodiments, an adjustable garment system may include at least one folding fastener. The folding fastener when activated may hold the third portion of material against the first and/or second portion of material. The folding fastener may hold the third portion of material substantially flat against the first and/or second portion of material such that the third portion of material is inhibited from interfering with a wearer of the garment during use. For example, when a user is putting a shirt on and putting their arm through a sleeve opening including folding fasteners the folding fasteners may flatten the third portion of material (which may in some instances be referred to as a flap) against the material forming the sleeve such that the user's arm does not get caught on the flap.

In some embodiments, the third portion of material is formed from a different material than the first and second portions of material. The third portion of material may include a stretchable material which when the fasteners are unfastened allows the second diameter to vary over a range. The stretchable material may include what is referred to in the industry as stretch fabric. Stretch fabric may include 2-way stretch or 4-way stretch. 2-way stretch fabrics stretch in one direction, usually from a finished edge to a finished edge (but may be in other directions depending on the knit). 4-way stretch fabrics, such as spandex, stretches in both directions, crosswise and lengthwise. Using a stretch fabric, for example, may allow the second diameter to include a variable diameter over a range with the minimum of the range having a larger diameter than the first diameter.

The third portion of material may be made from other stretchable materials or from some other flexible materials which are not particularly stretchable. The third portion of material may be formed from the same material as that of the garment. In some embodiments, the third portion of material may be formed of a waterproof or water repellant material which can be unfolded, unrolled, or expanded (e.g., beyond the original length of the, for example, sleeve) to protect the affected area and devices from moisture. In some embodiments, the third portion of material may be made 'oversized' to protect a larger area than the area directly affected by the cast, bandage, brace, or prosthetic device.

In some embodiments, the third portion of material may be colored in different colors from the garment to either highlight the flap or camouflage the flap so it is not as easily noticed. As well the fasteners may be highlighted with different colors or materials.

In some embodiments, a garment may include two or more adjustable garment systems incorporated therein. Specifically garments may include an article of clothing worn by a person including an opening in the garment meant for a portion (e.g., an appendage) of the person to be conveyed through. The garment may include a first adjustable garment system associated with a first opening in the garment and a second adjustable garment system associated with a second opening in the garment. For example a shirt may include a first adjustable garment system associated with a first shirt sleeve and a second adjustable garment system associated with a second shirt sleeve. This advantageously allows a shirt to be used by a disabled person who has either, for example, a broken left arm, right arm, or two broken arms. Increasing versatility of a garment may reduce production costs and/or increase popularity/sales.

In some embodiments, the third portion of material may be incorporated into an existing premade garment or formed as part of the garment during manufacture of the garment. The third portion of material may be permanently attached to the body of the garment (e.g., via thread and sewn in place). The third portion of material may be temporarily attached to the body of the garment (e.g., via fasteners etc.).

Figure 5:
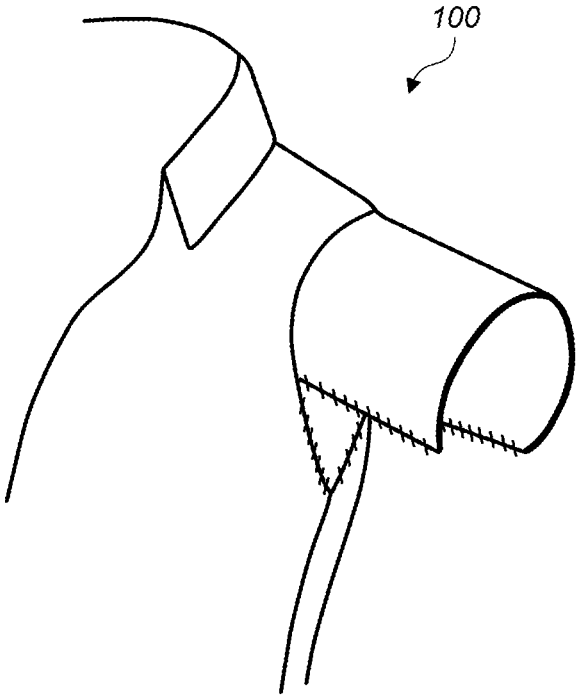
FIG. 5 depicts an embodiment of a button down short sleeve shirt cut to accept the flap.

In some embodiments, a method of incorporating a "flap" into a garment may include cutting along, for example, a seam of a shirt sleeve. The sleeve may be cut from the outermost bottom edge, along the bottom of the seam, to the armpit of the shirt. The cut may continue past the armpit down the side body of the shirt approximately three inches. FIG. 5 depicts an embodiment of a button down short sleeve shirt 100 cut to accept the flap.

Figure 6:
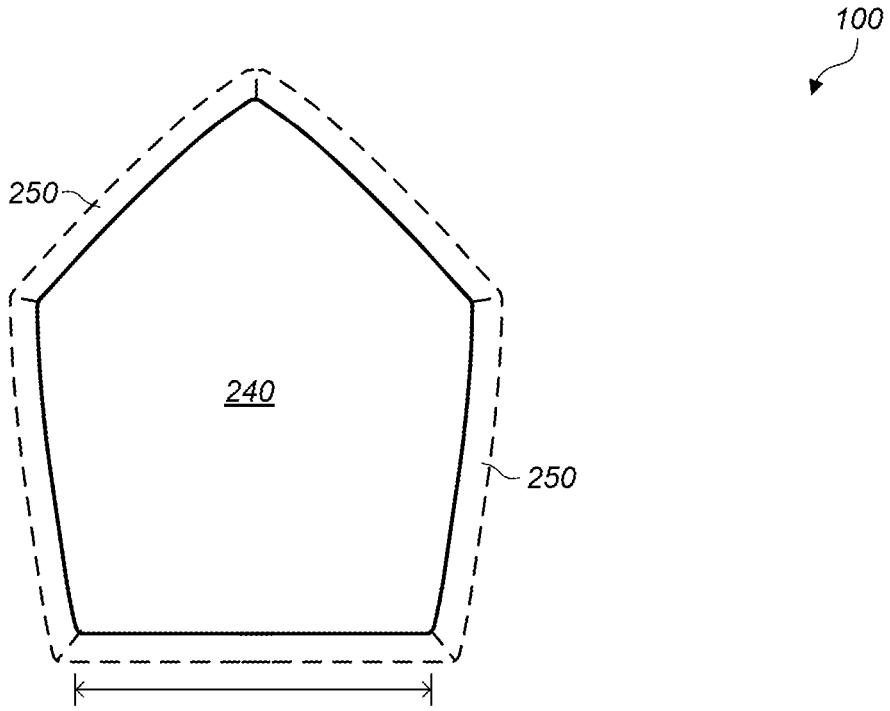
FIG. 6 depicts an embodiment of a template for flaps which will be inserted into a short sleeve shirt.

The flap or third portion of material may be cut from a separate piece of material. FIG. 6 depicts an embodiment of a template for flaps 240 which will be inserted into a short sleeve shirt. The base width of the flap may be approximately 50% larger than the circumference of the existing shirt sleeve (before cutting the seam). The length of the flap should be the length of the existing sleeve plus the distance cut down below the armpit (with allowances 250 made for finishing the seams). The flap may be formed of two or more pieces of material (e.g., to allow for a better and more comfortable fit, and for manufacturing necessities). The flap may be sewn into position around the underarm of the shirt. The flap may be sewn into the shirt in such a way as to best accommodate folding out of the way when not being used. Fasteners may be placed to hold the flap in position. One set of fasteners may hold the sleeve in a closed position, for the 'normal' or uninjured arm, making it appear to be a normal sleeve for all practical purposes. One set of fasteners may be attached to the sleeve and flap to hold the flap out of the way when not being utilized. In some embodiments, after a medical device (e.g., cast, brace, bandage, prosthetic, etc.) is removed, the user has the option to remove the flap either by undoing the fasteners or severing the threads that hold it in position.

In some embodiments, the garment may include fasteners which may be manipulated using a single hand due to the fact that the user is disabled. This allows the user in the cast to completely dress him or her-self. For example, snaps (e.g., plastic or metal) such as those used in baby clothes may be used. If snaps are used as fasteners, the male/female snaps may be aligned to make the most efficient use of the connections.

In some embodiments, a series of fasteners along different axis may be used to provide different closure levels.

In some embodiments, the third portion of material comprises a container for transporting items (e.g., electronics, flashlight, instrumentation, medical information and or other devices). The container may include an opening and some type of different fastener for closing the container.

In some embodiments, systems described herein may be used outside of the medical industry (e.g., carrying/concealing tools, weaponry, exoskeletal and prosthetic devices).

In some embodiments, the flap may be sized appropriately to accommodate different sized shirts, pants, and jackets. For example, systems described herein may be utilized for lower extremity casts (e.g., Spica Cast required by hip displaysia patients).

Figure 7:
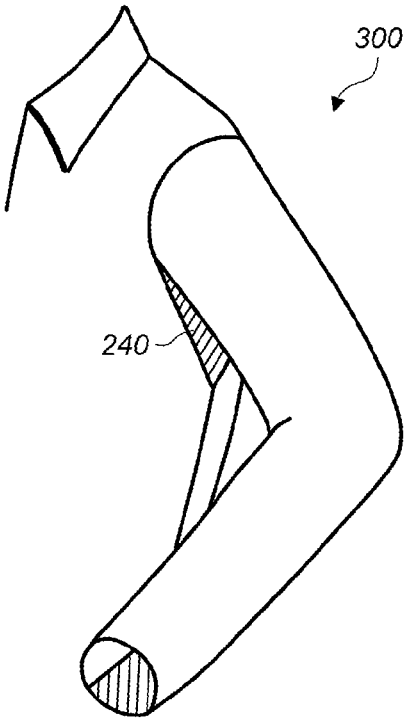
FIG. 7 depicts an embodiment of a flap inserted into a long sleeve shirt, expanded.
Figure 8:
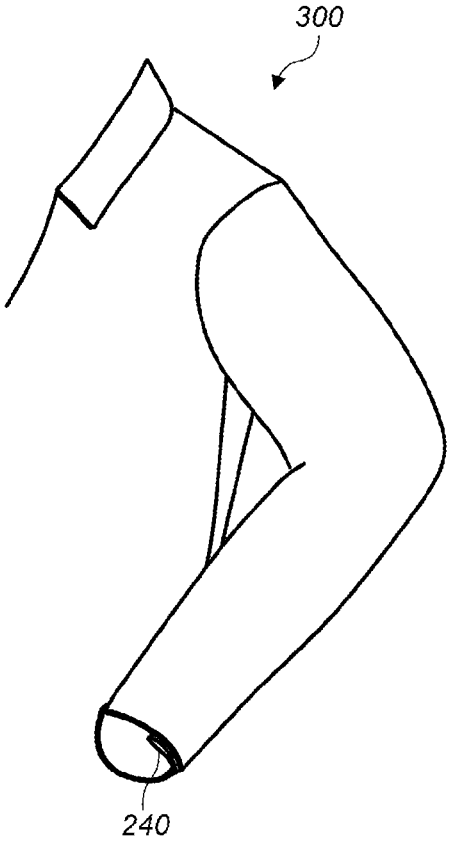
FIG. 8 depicts an embodiment of flap inserted into a long sleeve shirt, compressed.
Figure 9:
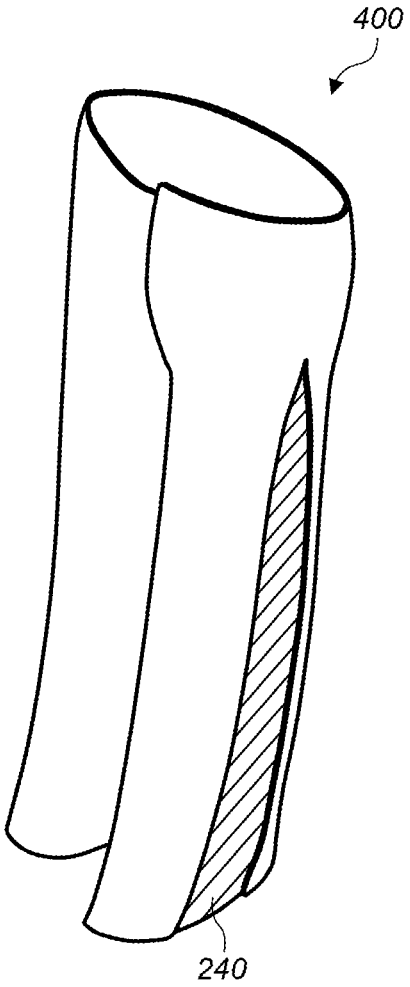
FIG. 9 depicts an embodiment of setup for a pair of pants expanded.
Figure 10:
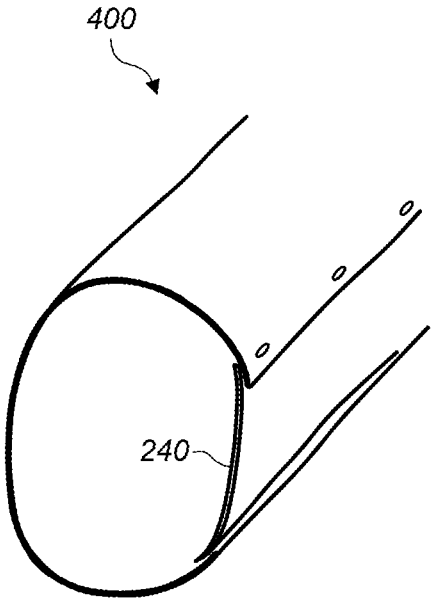
FIG. 10 depicts an embodiment of setup for a pair of pants expanded
Figure 11:
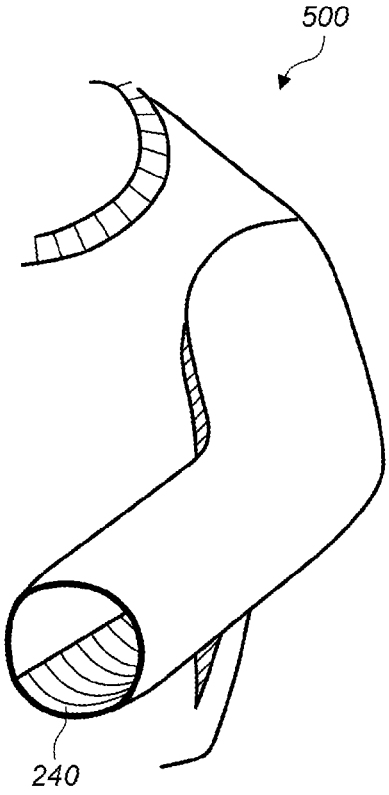
FIG. 11 depicts an embodiment of setup for jacket expanded
Figure 12:
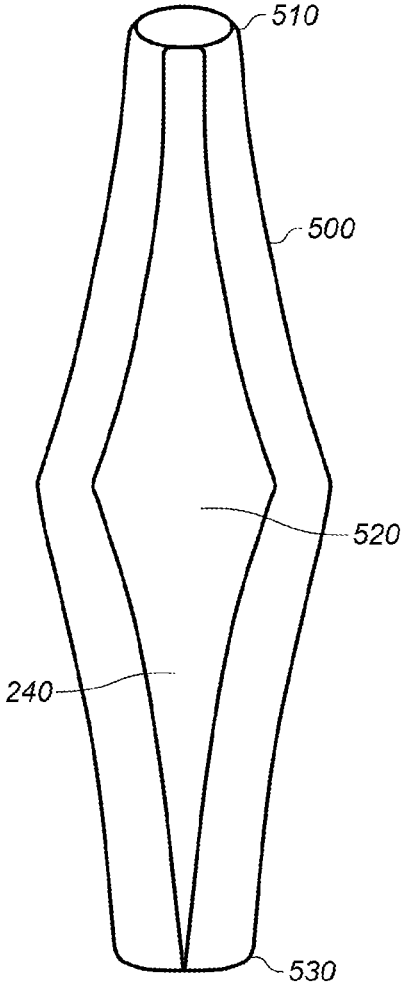
FIG. 12 depicts an embodiment of setup for jacket expanded.

In some embodiments, specifically garments may include an article of clothing worn by a person including an opening in the garment meant for a portion (e.g., an appendage) of the person to be conveyed through. Garments may include shirts (e.g., short sleeve and long sleeve), pants, shorts, sweaters, and/or jackets. For example, an adjustable garment system may be incorporated into a long sleeve shirt (e.g., FIGS. 7-8 depicts an embodiment of a flap 240 inserted into a long sleeve shirt 300, expanded and contracted respectively). For example, an adjustable garment system may be incorporated into a pair of pants 400 (e.g., FIGS. 9-10 depicts an embodiment of a flap 240 inserted into a pair of pants 400, expanded). For example, an adjustable garment system may be incorporated into a jacket 500 (e.g., FIG. 11 depicts an embodiment of a flap 240 inserted into a jacket 500, expanded; FIG. 12 depicts a side view of an embodiment of a flap 240 inserted into a jacket 500, expanded from a wrist 510 to armpit 520 to waist 530).

In some embodiments, a system and/or method a may include adjusting an opening in a garment. The method may include disconnecting at least one fastener attaching a first portion of material to a second portion of the material forming an opening in a garment with a first diameter. The method may include expanding the first opening from the first diameter to a second larger diameter using a third portion of material attaching the first portion to the second portion of material. The method may include inserting an appendage of a user through the expanded opening. At least a portion of the appendage may include a medical device. The medical device may be inhibited from conveying through the opening with the first diameter. In some embodiments, the method may include folding the third portion of material within the first diameter of the opening when the at least one fastener is activated.

In some embodiments, a method may include activating the at least one fastener to attach the first portion of material to the second portion of the material forming the opening. After the fastener is activated the opening may be now locked into the first diameter after the medical device of the appendage has passed through the opening.

Figure 13:
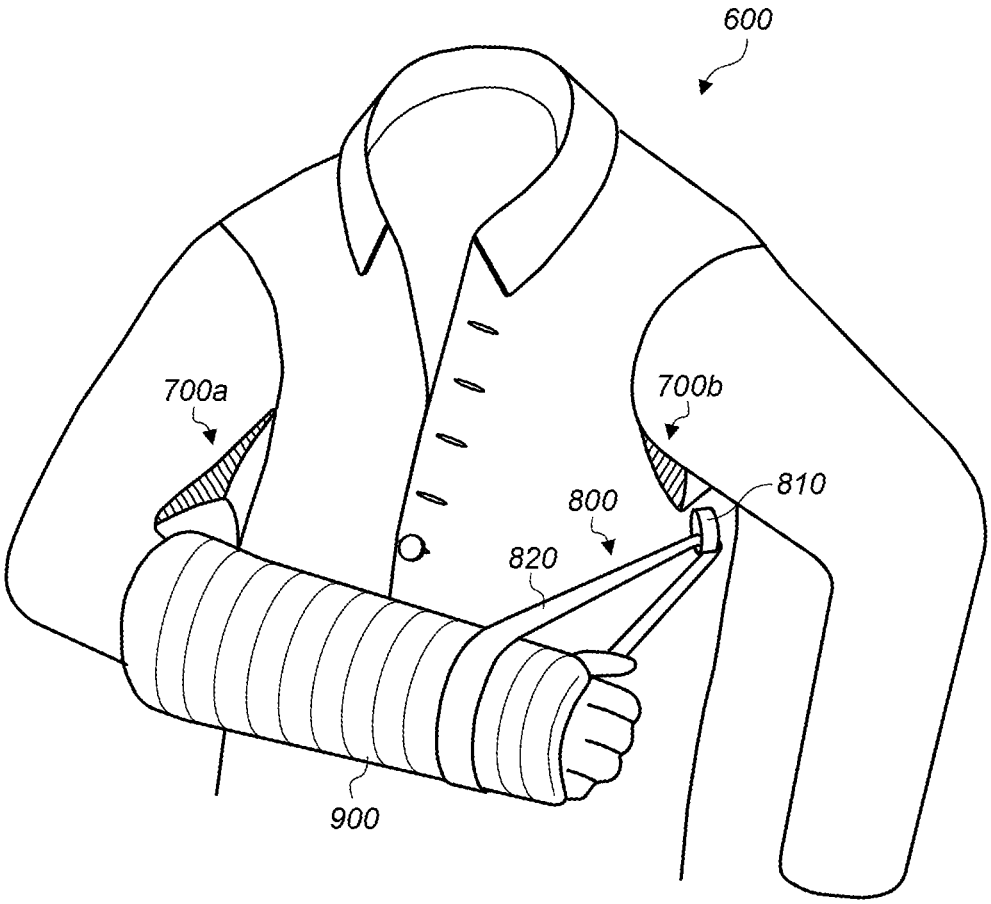
FIG. 13 depicts an embodiment of setup for a shirt including an adjustable garment system and an appendage support system.

FIG. 13 depicts an embodiment of setup for a shirt 600 including an adjustable garment system 700 and an appendage support system 800. In some embodiments, an appendage support system may include a coupling member 810. The coupling member 810 may accept during use an elongated member 820 which couples to a disabled appendage 900 in order to provide support. Support may be provided in the form of assisting in the elevation of the disabled appendage 900 to reduce stress on the disabled appendage in order to, for example, promote healing.

The coupling member 810 may include a loop of material or a fastener (including one or more examples described herein such as a hook). An elongated member 820 may couple to the coupling member. The elongated member may include a strap of strong and/or lightweight material. A length of the elongated material may be adjustable in order to better support the appendage and/or for persons of different size. The elongated member may be formed from two or more portions which couple to one another using fastening means as described herein. In some embodiments, the elongated member may be directly attached to the adjustable garment system 700.

In some embodiments, a garment may include at least two adjustable garment systems 700*a-b* such that a disable appendage may be conveyed through a first opening outfitted with a first adjustable garment system 700*a* and a second adjustable garment system 700*b* includes an appendage support system 800 which supports the disabled appendage. In this example the shirt may include an appendage support system associated with one or both adjustable garment systems. A portion or all of the appendage support system may be concealed within the adjustable garment system when not in use (e.g., as in when the third portion of material is folded up within the system when not in use).

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the embodiments described in this disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described herein are to be taken as the presently preferred embodiments. Elements and materials may be substituted for those illustrated and described herein, parts and processes may be reversed, and certain features of the embodiments may be utilized independently, all as would be apparent to one skilled in the art after having the benefit of this description. Changes may be made in the elements described herein without departing from the spirit and scope of the following claims.

What is claimed is:

1. A method, comprising:

disconnecting at least one fastener attaching a first portion of material to a second portion of the material forming an opening in a garment with a first diameter, wherein the garment comprises a shirt and the opening is formed as part of a sleeve of the shirt;

expanding the first opening from the first diameter to a second larger diameter using a third portion of material attaching the first portion to the second portion of material;

inserting an appendage of a user through the expanded opening, wherein at least a portion of the appendage comprises a medical device, wherein the medical device is inhibited from conveying through the opening with the first diameter, and wherein the medical device is a cast, brace, or prosthetic; and activating the at least one fastener to attach the first portion of material to the second portion of the material forming the opening such that the opening comprises the first diameter after the medical device of the appendage has passed through the opening.

2. The method of claim 1, further comprising folding the third portion of material coupling the first portion to the second portion within the first diameter of the opening when the at least one fastener is activated attaching the first portion to the second portion.

3. The method of claim 1, wherein the third portion of material comprises stretch fabric.

4. The method of claim 1, wherein the at least one fastener comprises a button, a snap, a zipper, or hook and loop.

5. The method of claim 1, wherein the garment comprises a short-sleeved shirt.

6. The method of claim 1, wherein the garment comprises a short-sleeved shirt and the opening is formed as part of a sleeve of the short-sleeved shirt.

7. The method of claim 1, wherein the third portion of material comprises a container for transporting items.

8. The method of claim 1, further comprising:

enlarging the opening by cutting the material forming the opening where the first portion and the second portion of material are attached;

attaching the third portion of material to the first and the second portions of material.

9. The method of claim 1, further comprising physically supporting the appendage using an appendage support system.

10. The method of claim 1, further comprising:

coupling the appendage to a coupling member of an appendage support system using an elongated member of the appendage support system; and physically supporting the appendage using the appendage support system.

11. A method, comprising:

disconnecting at least one fastener attaching a first portion of material to a second portion of the material forming an opening in a garment with a first diameter, wherein the garment comprises a shirt and the opening is formed as part of a sleeve of the shirt;

expanding the first opening from the first diameter to a second larger diameter using a third portion of material attaching the first portion to the second portion of material, wherein the third portion of material is formed from a different material than the first and second portions of material; and inserting an appendage of a user through the expanded opening, wherein at least a portion of the appendage comprises a medical device, wherein the medical device is inhibited from conveying through the opening with the first diameter, and wherein the medical device is a cast, brace, or prosthetic.

12. The method of claim 11, wherein the third portion of material comprises a container for transporting items.

13. The method of claim 11, further comprising:

enlarging the opening by cutting the material forming the opening where the first portion and the second portion of material are attached;

attaching the third portion of material to the first and the second portions of material.

14. The method of claim 11, further comprising physically supporting the appendage using an appendage support system.

15. The method of claim 11, further comprising:

coupling the appendage to a coupling member of an appendage support system using an elongated member of the appendage support system; and physically supporting the appendage using the appendage support system.

* * * * *